US007079799B2

(12) United States Patent
Mills, III et al.

(10) Patent No.: US 7,079,799 B2
(45) Date of Patent: Jul. 18, 2006

(54) CLEANING DEVICE AND FUSER ASSEMBLY FOR A PRINTER WITH MULTIPLE CLEANING BLADES HELD BY A COMMON MOUNT

(75) Inventors: Borden H. Mills, III, Webster, NY (US); Kurt E. Jones, Webster, NY (US); Steven P. Bailey, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 33 days.

(21) Appl. No.: 10/928,934

(22) Filed: Aug. 27, 2004

(65) Prior Publication Data

US 2006/0045582 A1 Mar. 2, 2006

(51) Int. Cl.
*G03G 15/20* (2006.01)

(52) U.S. Cl. ..... 399/327; 399/350; 399/351

(58) Field of Classification Search ..... 399/99, 399/101, 123, 325, 326, 327, 343–353; 15/256.51, 15/256.52
See application file for complete search history.

(56) References Cited

U.S. PATENT DOCUMENTS

| | | | | |
|---|---|---|---|---|
| 3,794,417 | A | 2/1974 | Machmer | |
| 3,935,836 | A | 2/1976 | Bar-on | |
| 3,940,238 | A | 2/1976 | Bar-on | |
| 3,941,085 | A | 3/1976 | Hattler et al. | |
| 3,986,227 | A | 10/1976 | Fathergill et al. | |
| 3,989,005 | A | 11/1976 | Bowler, Jr. et al. | |
| 4,407,219 | A * | 10/1983 | Dellevoet | 118/60 |
| 4,488,504 | A | 12/1984 | Vineski | |
| 4,711,549 | A * | 12/1987 | Roodbeen | 399/308 |
| 5,043,768 | A | 8/1991 | Baruch | |
| 5,601,926 | A | 2/1997 | Moser | |
| 5,991,568 | A | 11/1999 | Ziegelmuller | |
| 6,219,521 | B1 * | 4/2001 | Burdick et al. | 399/327 |

FOREIGN PATENT DOCUMENTS

| | | |
|---|---|---|
| GB | 1 456 239 | 11/1976 |

* cited by examiner

*Primary Examiner*—Hoang Ngo
(74) *Attorney, Agent, or Firm*—Donna P. Suchy

(57) ABSTRACT

The invention relates to cleaning deposits from a moving surface within a printer. According to just one aspect of the invention a cleaning device for cleaning a moving surface in a printer is provided. The cleaning device includes a blade defining at least one cleaning edge configured to engage the moving surface in the printer, the blade including a multitude of blade segments spaced along a width thereof.

22 Claims, 4 Drawing Sheets

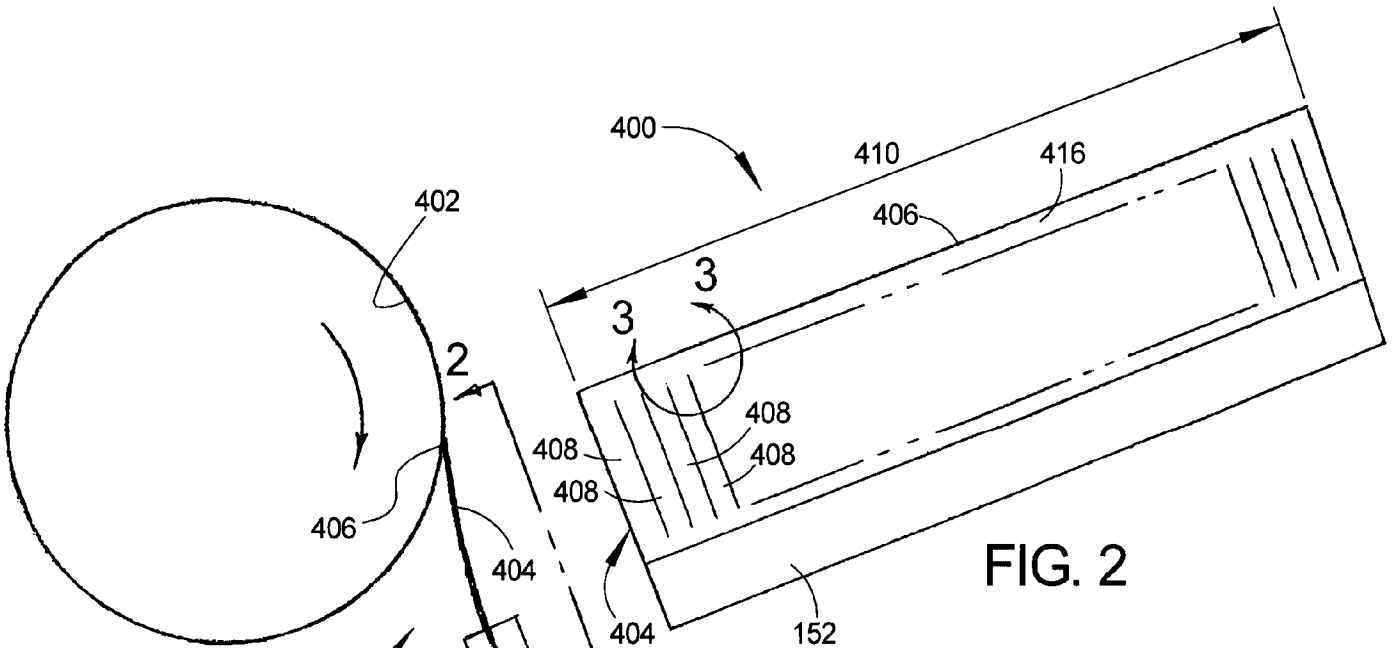
FIG. 2
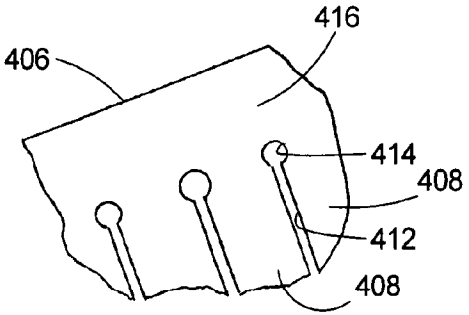
FIG. 3
FIG. 1

CLEANING DEVICE AND FUSER ASSEMBLY FOR A PRINTER WITH MULTIPLE CLEANING BLADES HELD BY A COMMON MOUNT

BACKGROUND

The invention relates to cleaning deposits from rollers in a fusing apparatus for a printer.

Variable information may be added to media pre-printed, for example by offset lithography, using digital printing machines, such as the Digimaster® 9110 available from Nexpress Solutions LLC, Rochester, N.Y. Pre-printed media may generate an unacceptable level of contamination of a fuser in a printer, and in particular, on an externally heated roller fuser. With pre-printed media generated by an offset printing process, the contamination is caused by transfer of offset inks and spray powder to the fuser components, and in particular the fuser roller. Such contamination typically causes image defects and release failure of printed/fused materials from the fuser roller. This results in frequent service calls to replace fuser parts.

BRIEF DESCRIPTION OF THE DRAWINGS

FIG. 1 presents a schematic end view of a moving surface and cleaning device according to one aspect of the invention.

FIG. 2 presents a schematic plan view of a cleaning device according to one aspect of the invention taken along line 2—2 of FIG. 1.

FIG. 3 presents an enlarged view with portions broken away taken along line 3—3 of FIG. 2.

DETAILED DESCRIPTION

Figure 4:
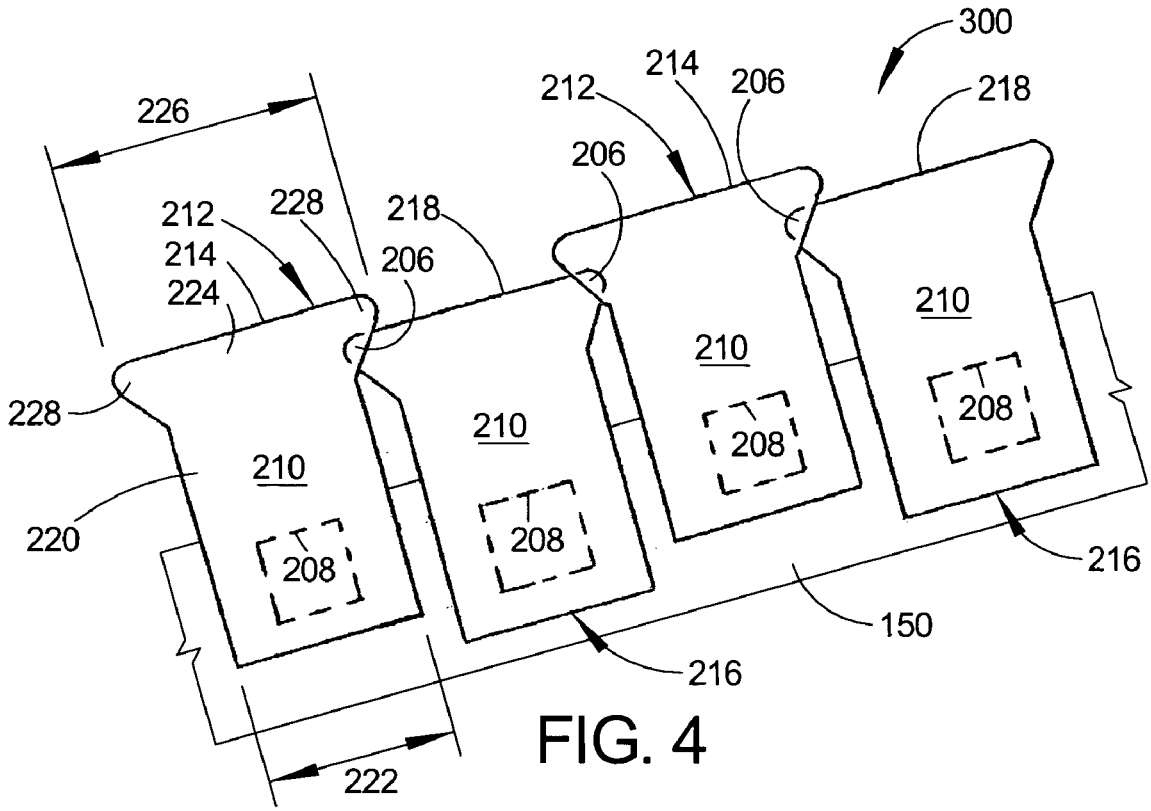
FIG. 4 presents a schematic plan view of a cleaning device according to one aspect of the invention.

Various aspects of the invention are now presented with reference to the drawings, which are not drawn to any particular scale, and wherein like components in the numerous views are numbered alike. As used herein, "first", "second", and "third" are used for reference only, do not indicate any particular order, and are not intended to limit the invention. Referring now specifically to FIGS. 1 and 2, a cleaning device 400 for cleaning a moving surface 402 in a printer is presented. The cleaning device 400 comprises a blade 404 defining at least one cleaning edge 406 configured to engage the moving surface 402 in the printer. The blade comprises a multitude of blade segments 408 spaced along a width 410 thereof. According to one aspect of the invention, the blade segments render the blade 404 conformable to the moving surface 402 in a lengthwise direction. The blade 404 may be held by a mount 152, for example it may be held within a C-shaped channel (retained).

Figure 9:
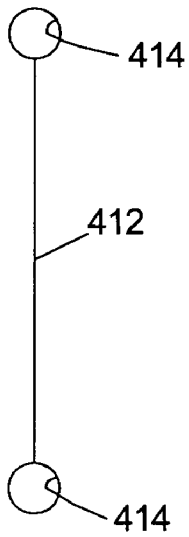
FIG. 9 presents an alternative embodiment of a slit according to one aspect of the invention.
Figure 10:
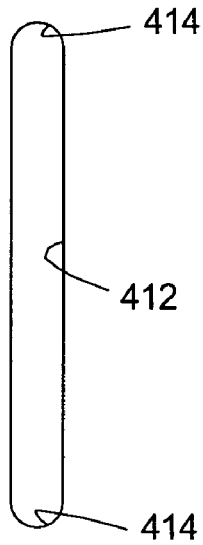
FIG. 10 presents an alternative embodiment of a slit according to one aspect of the invention.

The multitude of blade segments 408 may be defined in various ways. Referring now to FIG. 3, the multitude of blade segments 408 are defined by a multitude of slits 412 in the blade 404 transverse to the width 410. Each of the multitude of slits 412 may terminate at a pair of radiuses 414 in the blade 404 configured as round holes. Alternatively, the multitude of blade segments 408 being defined by a multitude of linear crimps in the blade transverse to the width 410 instead of the slits 412. A unitary marginal portion 416 may extend along the width 410 integrally formed with the segments 408 and defining the cleaning edge 406. Referring now to FIG. 9, an alternative embodiment is presented wherein the slit 412 is merely a cut in the blade material and terminates at the pair of radiuses 414 in the blade 404, configured as round holes. This arrangement is less preferred because the individual blade segments can become displaced above and below each other along the slit 412. Referring now to FIG. 10, an alternative embodiment is presented wherein the slit 412 has a width equivalent to the diameter of the circle segments defined by the radiuses 414.

Referring now to FIG. 4, a cleaning device 300 is presented according to an aspect of the invention. Cleaning device 300 comprises a mount 150. Each of the multitude of blade segments 408 of FIG. 2 comprises a separate blade 210 held in the mount 150. A first set 212 of the separate blades 210 (the blade segments 408 of FIG. 2) define a first set of cleaning edges 214 aligned in the widthwise direction (in direction of the width 410 of FIG. 2). A second set 216 of the separate blades 210 (the blade segments 408 of FIG. 2) may define a second set of cleaning edges 218 aligned in the widthwise direction displaced from the first set of cleaning edges 214 in a direction transverse to the widthwise direction. Members of the first set 212 of the multitude of blade segments 408 may be interleaved with members of the second set 216 of the multitude of blade segments 408. The first set 212 of the multitude of blade segments 408 and the second set 216 of the multitude of blade segments 408 may be superposed, as indicated at 206. In the embodiment of FIG. 4, the blades 404 comprise clip structures 208 that are received within mating openings in the common mount 150. One or more blades 210 may be replaced, as desired, merely by unclipping the blade 210 and replacing it with another.

Each separate blade 210 may comprise a body portion 220 having a first width 222 and a marginal portion 224 having a second width 226 wider than the first width and terminating in a cleaning edge 214. The cleaning edges 214 comprises radiused terminal ends 228 spaced from each other in a widthwise direction.

Figure 5:
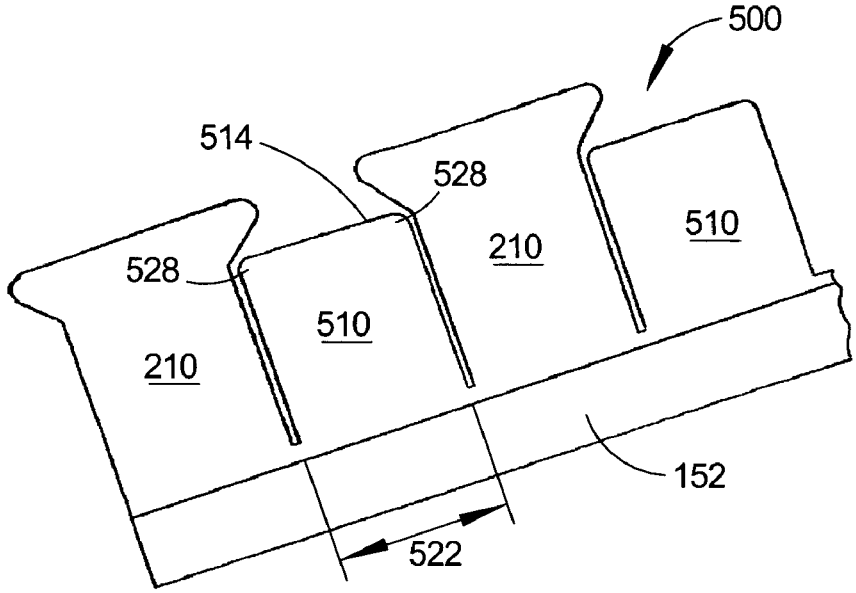
FIG. 5 presents a schematic plan view of a cleaning device according to one aspect of the invention.

Referring now to FIG. 5, a cleaning device 500 according to an aspect of the invention is presented. The cleaning device 500 comprises the mount 152. Each of the blade segments 408 of FIG. 2 are configured as blades 210 and 510 formed from a single sheet as a contiguous blade, for example by photoetching, stamping, or laser cutting. Alternatively, each the blades 210 and 510 may be separate blades held in a mount such as mount 150 by clips, for example. The first type of blade 210 may be the same as described in relation to FIG. 4. A second type of the separate blade 510 comprises a constant width 522 and terminating in cleaning edge 514. The first type of blade 210 alternates with the second type of blade 510 along the width of the cleaning device 500. Each of the blades 510 may comprise radiused terminal ends 528 spaced from each other in a widthwise direction.

Figure 6:
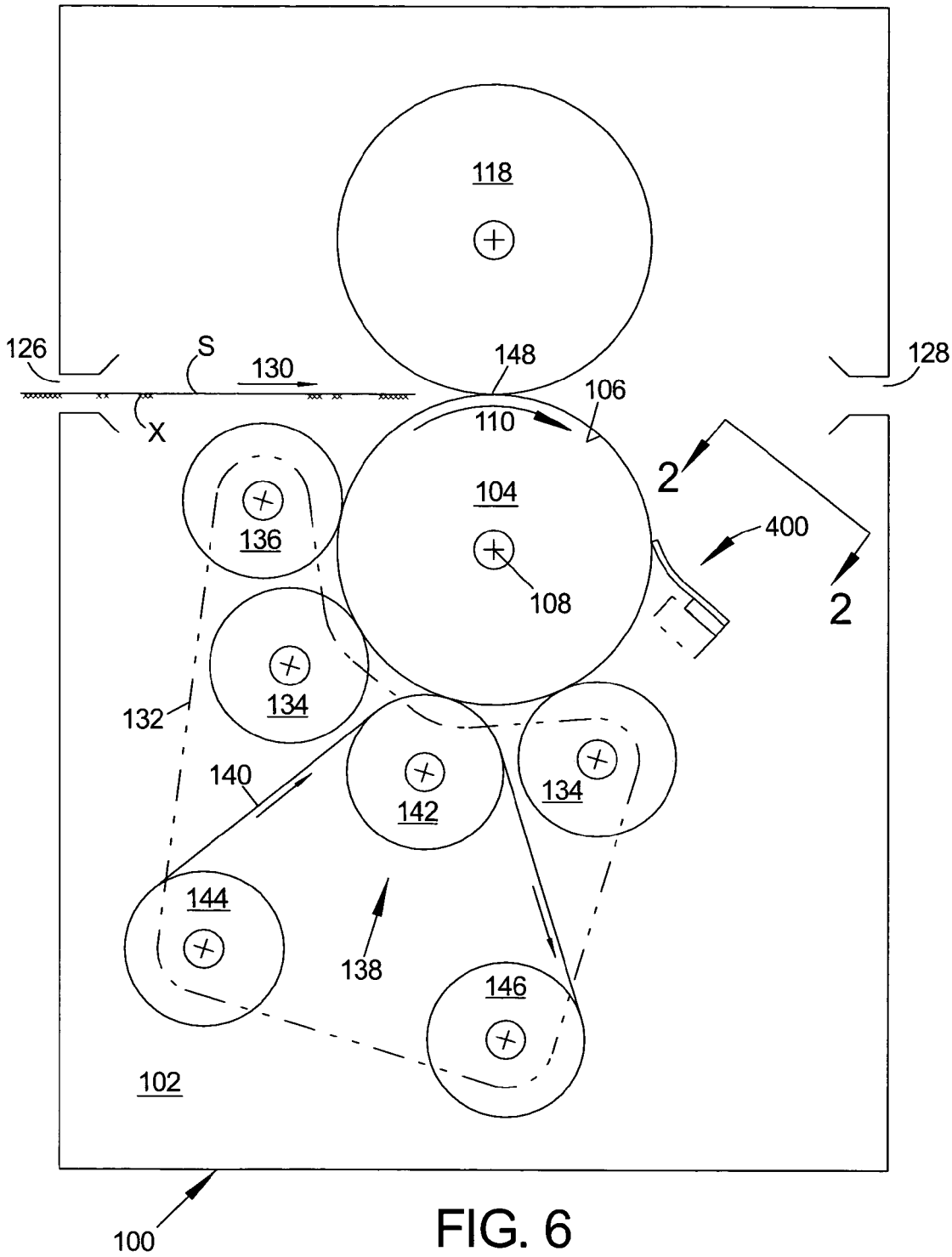
FIG. 6 presents a schematic side view of a fuser assembly to an aspect of the invention.

Referring now to FIG. 6, a fuser assembly 100 for a printer is presented. In the example presented in FIG. 1, the moving surface 106 is part of a fusing apparatus 100, but the invention can be used in other parts of a printer. The fuser assembly 100 comprises a support 102. The moving surface may be an outer circumferential surface of a roller 104 held by the support 102, the roller defining the circumferential surface and being rotatable about an axis 108 relative to the support 102. Another example of a moving surface is a fuser belt that defines the moving surface, which is also a fusing surface. A fuser belt system is disclosed in U.S. Pat. No. 6,096,427 issued Aug. 1, 2000 to Chen et al. This patent is hereby incorporated in its entirety by reference as if fully set forth herein. A fusing nip 148 may be formed with another roller 118, or a fuser belt. The cleaning device 200 engages the moving surface 106.

A sheet S enters the fuser assembly 100 from the left through entry 126, passes through the fusing nip 148, and exits the fuser assembly 100 to the right through exit 128. Other configurations and are contemplated in the practice of the invention, the particular configuration not being critical in the practice of the invention. The sheet S has ink particles X deposited on it, for example by inkjet, electrographic, or other means that apply marking material to the sheet S, and the ink particles X may comprise ink, dye, and/or toner. The sheet S passes between the rollers 104 and 118 under pressure and/or heat, in the direction of arrow 130. This process fixes the ink particles X to the sheet S, as is well known in the art. As used herein "fuser" and "fusing" refers to apparatus and processes for stabilizing an image on a receiver by heat and/or pressure. Appropriate sheet handling apparatus (not shown) is provided within the fuser that carries the sheet S from the entry 126, through the nip between the rollers 104 and 118, and to the exit 128.

The cleaning device 300, 400, 500 etc., may be constructed as separate replaceable units.

The moving surface 106 (circumferential surface, fusing surface, etc.) may comprise material deposited from pre-printed media, for example offset ink and/or powder. The powder is applied to inhibit smearing, offsetting, and blocking in an offset printing process, as is described on pages 176 and 249–250 of Hemult Kipphan, HANDBOOK OF PRINT MEDIA (Springer 2001), and is residual on pre-printed media. According to one aspect of the invention, the cleaning blades remove such material. Of course, the cleaning blades may be implemented to remove contamination from any source.

Figure 7:
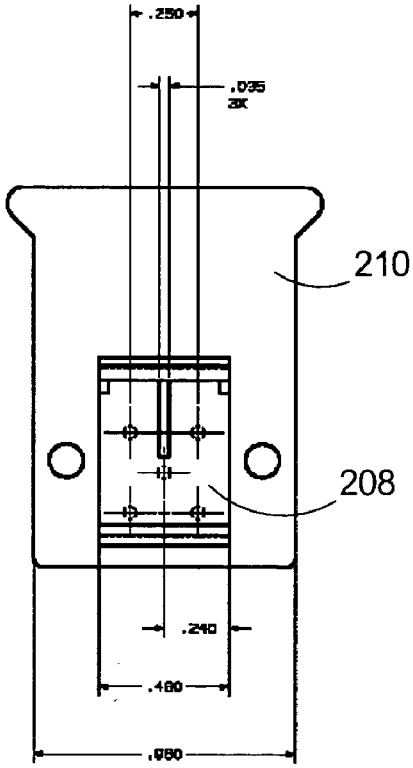
FIG. 7 presents a plan view of a cleaning blade with a clip structure according to one aspect of the invention.
Figure 8:
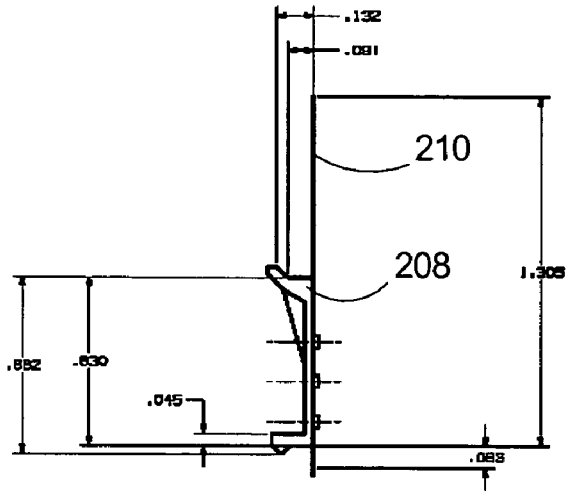
FIG. 8 presents a side view of the FIG. 6 cleaning blade and clip structure.

Referring now to FIGS. 7 and 8, the cleaning blade 210 is presented with a detailed view of one example of the clip structure 208 that may be implemented in the practice of the invention. The dimensions in FIGS. 7 and 8 are in inches. The clip 208 is received within a corresponding rectangular hole in the mount 150. The clips 208 may be formed from a high temperature resistant plastic. A high temperature injection moldable thermoplastic, such as polyetherimide, may be implemented. An example of a suitable material is Ultem® 1000 Black polyetherimide available from the General Electric Company, USA. The clips 208 may be mechanically fastened, bonded, welded, or molded to the blades 210. In the example presented in FIGS. 7 and 8, the clips 208 are provided with posts that extend through receiving holes in the cleaning blade 210, and the ends are flattened by ultrasonic welding. The outside diameter of the posts may be increased to provided increased resistance to skiving forces. Other mounting techniques may also be implemented to increase resistance to skiving forces, for example outsert molding.

The material of cleaning blades 210 may be any material capable of withstanding the heat and abrasiveness of the fuser and/or pressure rollers or other surface to which it is applied. One example of a suitable material is a thin spring steel between 0.002 and 0.006 inches thick. A 0.004 inch thick extra spring temper cold rolled steel strip may be implemented. The included angle of contact between the blade and a tangent to the surface at the point of contact with the moving surface 106 may be on the order of 0 to 30 degrees, inclusive, and may be on the order of 10 to 20 degrees, inclusive. The tip force perpendicular to the moving surface 106 at the point of contact may be on the order of 1 ounce to 5 ounces per linear inch, inclusive, and may be between 2 ounces and 4 ounces per linear inch, inclusive.

The moving surface 106 (circumferential surface, fusing surface, etc.) may comprise material deposited from pre-printed media, for example offset ink and printer's offset powder. According to one aspect of the invention, the cleaning blades remove such material. Of course, the cleaning blades may be implemented to remove contamination from any source.

The support 102 may take any suitable configuration. It generally comprises a frame and is composed of numerous separate components although a simple fuser may have a monolithic support. The support 102 may comprise one or more additional supports 132 (shown in phantom). The components may be interconnected by bonding, welding, mechanical fastening, or any other suitable method. Such assemblies are typically fabricated for subsequent disassembly in order to provide ready access to replaceable parts.

The fusing surface may be heated. Generally, heating is accomplished internally or externally. In the example of FIG. 6, a pair of heating rollers 134 are provided that contact the circumferential surface 106. The heating rollers 134 have internal radiant heaters, for example heat lamps. Any type of heating may be implemented in the practice of the invention.

Furthermore, a surface treatment may be applied to the moving surface 106 by a roller 136, as described in Provisional Patent Application Ser. No. 60/540,883 entitled "METHOD AND APPARATUS FOR VARIABLE WIDTH SURFACE TREATMENT APPLICATION TO A FUSER", filed Jan. 30, 2004, the contents of which are hereby incorporated by reference as if fully set forth herein. As described in that application the surface treatment may be a substance that promotes release of the fused sheet from the fuser roller 104, for example silicone oil. The roller 136 may be a porous wick roller, for example a porous ceramic cylinder covered with fabric. Silicone oil may be fed to it from a perforated tube disposed inside the ceramic cylinder.

Additional cleaning may be added, as described in Provisional Patent Application Ser. No. 60/582,482 entitled "VARIABLE FUSER FOR PRINT MEDIA", filed Jun. 24, 2004, the contents of which are hereby incorporated by reference as if fully set forth herein. In the embodiment of FIG. 1, a web cleaner 138 is provided that incrementally moves a web 140 over the surface of a tensioner roller 142 from a supply roll 144 to a take-up roll 146. An example of a web cleaner that may be implemented is described in U.S. Pat. No. 6,631,251, issued Oct. 7, 2003, entitled "Fuser web cleaning assembly for an electrophotographic machine", the contents of which are hereby incorporated by reference as if fully set forth herein. The web 140 may be comprised of any flexible, cleaning material which is capable of removing contaminants from fuser surface 106 upon contact (e.g. woven cloth-like material such as a NOMEX® aromatic polyamide fiber) without damaging it. Alternatively, or in addition, the web cleaner 138 may be applied to one or both heating rollers 134.

The heating roller 134, roller 136, and cleaning assembly 138, may be held by one or more additional supports 132

(shown in phantom) that, in turn, are held by the support 102. The exact configuration is not critical in the practice of the invention to the extent that the components do not interfere with each other and the sheet S is free to move through the fuser assembly 100 without obstruction.

In the embodiments described herein with reference to FIG. 6, the roller 104 comprises a fuser roller but, according to a further aspect of the invention, the cleaning devices according to the invention could also be applied to a pressure roller, such as roller 118. Furthermore, the cleaning device 200 could be applied to both fuser roller 104 and pressure roller 118.

A fuser roller 104 may comprise a core, for example made of aluminum, and a cylindrical fusing blanket supported on the core. The blanket is typically made of an elastomeric material such as rubber particularly formulated to be heat conductive or heat insulative dependent upon whether the fuser heat source is located within the core or in juxtaposition with the periphery of the blanket. The blanket defines an elastomeric body. An example of a fuser roller is disclosed in United Patent Application Publication US 2004/0023144 A1, filed Aug. 4, 2003, in the names of Jerry A. Pickering and Alan R. Priebe, the contents of which are incorporated by reference as if fully set forth herein. The pressure member 118 may be similarly constructed, for example a metallic core (such as aluminum) covered by an elastomeric cushion (such as filled silicone elastomer), covered by a perfluoroalkoxy or tetrafluoroethylene plastic sleeve. Other examples of elastomeric bodies include fusing belts and elastomeric pressure roller blankets.

The cleaning blades of the invention may be mounted in numerous suitable ways, for example by retaining and/or clipping. The blades tend to heat during operation, so relatively large contiguous blades may be mounted in a manner that permits thermal expansion and contraction relative to the mount, for example a retainer with mounting holes elongated in a widthwise direction would allow the blade to expand and contract in the widthwise direction while remaining fully constrained. This may also be applied to narrower blades to the extent that relief for thermal expansion and contraction is desired.

According one aspect of the invention, the cleaning device is conformable to a surface to be cleaned. The cleaning device may be conformable across the width of a roller (or other moving surface) such as a heater roller or a pressure roller, and may be rendered more conformable than a single piece blade extending across the same widthwise distance. This feature may improve the cleaning characteristics of the cleaning device.

The claims should not be read as limited to the described order or elements unless stated to that effect. As used herein, "first", "second", and "third" are used for reference only, do not indicate any particular order, and are not intended to limit the invention. In addition, use of the term "means" in any claim is intended to invoke 35 U.S.C. §112, paragraph 6, and any claim without the word "means" is not so intended.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A cleaning device for cleaning a moving surface in a printer, comprising:

a blade defining at least one cleaning edge configured to engage the moving surface in the printer, the blade comprising a multitude of blade segments spaced along a width thereof and a unitary marginal portion extending along the width integrally formed with the segments and defining the cleaning edge.

2. The cleaning device of claim 1 the multitude of blade segments being defined by a multitude of slits in the blade transverse to the width.

3. The cleaning device of claim 1 the multitude of blade segments being defined by a multitude of crimps in the blade transverse to the width.

4. A cleaning device for cleaning a moving surface in a printer, comprising:

a blade defining at least one cleaning edge configured to engage the moving surface in the printer, the blade comprising a multitude of blade segments spaced alone a width thereof and a unitary marginal portion extending along the width integrally formed with the segments and defining the cleaning edge, the multitude of blade segments being defined by a multitude of slits in the blade transverse to the width.

5. The cleaning device of claim 4, each of the multitude of slits terminating at a pair of radiuses in the blade.

6. A cleaning device for cleaning a moving surface in a printer, comprising:

a blade defining at least one cleaning edge configured to engage the moving surface in the printer, the blade comprising a multitude of blade segments spaced along a width thereof, the multitude of blade segments comprising radiused terminal ends spaced from each other in a widthwise direction.

7. A cleaning device for cleaning a moving surface in a printer, comprising:

a blade defining at least one cleaning edge configured to engage the moving surface in the printer, the blade comprising a multitude of blade segments spaced along a width thereof and comprising a mount, each of the multitude of blade segments comprising a separate blade held in the mount, the separate blade defining the at least one cleaning edge and having radiused terminal ends spaced from each other in a widthwise direction.

8. A cleaning device for cleaning a moving surface in a printer, comprising:

a blade defining at least one cleaning edge configured to engage the moving surface in the printer, the blade comprising a multitude of blade segments spaced along a width thereof;

a mount, each of the multitude of blade segments comprising a separate blade held in the mount;

a first set of the multitude of blade segments defining a first set of cleaning edges aligned in a widthwise direction;

a second set of the multitude of blade segments defining a second of cleaning edges aligned in the widthwise direction displaced from the first set of cleaning edges in a direction transverse to the widthwise direction.

9. The cleaning device of claim 8, members of the first set of the multitude of blade segments being interleaved with members of the second set of the multitude of blade segments.

10. A cleaning device for cleaning a moving surface in a printer, comprising:

a blade defining at least one cleaning edge configured to engage the moving surface in the printer, the blade comprising a multitude of blade segments spaced along a width thereof and comprising a mount, each of the multitude of blade segments comprising a separate blade held in the mount, each the separate blade comprising a body portion comprising a first width, and a marginal portion comprising a second width wider than the first width and terminating in a one of the at least one cleaning edges, wherein at least one of the blade segments comprises radiused terminal ends spaced from each other in a widthwise direction.

11. A cleaning device for cleaning a moving surface in a printer, comprising:

a blade defining at least one cleaning edge configured to engage the moving surface in the printer, the blade comprising a multitude of blade segments spaced along a width thereof;

a mount, each of the multitude of blade segments comprising a separate blade held in the mount;

a first type of the separate blade comprising a body portion comprising a first width, and a marginal portion comprising a second width wider than the first width and terminating in a one of the at least one cleaning edges;

a second type of the separate blade comprising a constant width and terminating in another of the at least one cleaning edges;

the first type alternating with the second type along the width wherein at least one cleaning edge and another of the cleaning edges comprise radiused terminal ends spaced from each other in a widthwise direction.

12. A fuser assembly for a printer comprising:

a support;

an elastomeric body held by the support and defining a movable surface subject to contamination;

a blade held by the support and defining at least one cleaning edge engaging the movable surface in the printer, the blade comprising a multitude of blade segments spaced along a width thereof, the multitude of blade segments being defined by a multitude of slits in the blade transverse to the width, each of the multitude of slits terminating at a pair of radiuses in the blade; and a unitary marginal portion extending along the width integrally formed with the segments and defining the cleaning edge.

13. The fuser assembly of claim 12, comprising a fusing belt that defines the movable surface.

14. The fuser assembly of 12, comprising a pressure roller that defines the movable surface.

15. The fuser assembly of claim 12, comprising a fusing roller that defines the movable surface.

16. The fuser assembly of claim 12, the multitude of blade segments being defined by a multitude of slits in the blade transverse to the width.

17. The fuser assembly of claim 12 the multitude of blade segments being defined by a multitude of crimps in the blade transverse to the width.

18. The fuser assembly of claim 12, comprising a mount, each of the multitude of blade segments comprising a separate blade held in the mount.

19. The fuser assembly of claim 12:

comprising a mount, each of the multitude of blade segments comprising a separate blade held in the mount;

comprising a first set of the at least one cleaning edges being aligned in a widthwise direction;

and comprising a second set of the at least one cleaning edges being aligned in the widthwise direction displaced from the first set in direction transverse to the widthwise direction.

20. The fuser assembly of claim 19, members of the first set being interleaved with members of the second set.

21. A fuser assembly for a printer comprising:

a support;

an elastomeric body held by the support and defining a movable surface subject to contamination;

a blade held by the support and defining at least one cleaning edge engaging the movable surface in the printer, the blade comprising a multitude of blade segments spaced along a width thereof, the one of the at least one cleaning edges comprising radiused terminal ends spaced from each other in a widthwise direction; and a mount, each of the multitude of blade segments comprising a separate blade held in the mount, each the separate blade comprising a body portion comprising a first width, and a marginal portion comprising a second width wider than the first width and terminating in a one of the at least one cleaning edges.

22. A fuser assembly for a printer comprising:

a support;

an elastomeric body held by the support and defining a movable surface subject to contamination; and a blade held by the support and defining at least one cleaning edge engaging the movable surface in the printer, the blade comprising a multitude of blade segments spaced alone a width thereof, a mount, each of the multitude of blade segments comprising a separate blade held in the mount;

a first type of the separate blade comprising a body portion comprising a first width, and a marginal portion comprising a second width wider than the first width and terminating in a one of the at least one cleaning edges;

a second type of the separate blade comprising a constant width and terminating in another of the at least one cleaning edges;

the first type alternating with the second type along the width, each the one of the at least one cleaning edges and each the another of the at least one cleaning edges comprising radiused terminal ends spaced from each other in a widthwise direction.

* * * * *

UNITED STATES PATENT AND TRADEMARK OFFICE

CERTIFICATE OF CORRECTION

PATENT NO. : 7,079,799 B2
APPLICATION NO. : 10/928934
DATED : July 18, 2006
INVENTOR(S) : Borden H. Mills, III et al.

It is certified that error appears in the above-identified patent and that said Letters Patent is hereby corrected as shown below:

Column 6, Line 20, Claim 4 Delete "alone" replace with --along--

Signed and Sealed this

Seventeenth Day of April, 2007

JON W. DUDAS
*Director of the United States Patent and Trademark Office*